US005317889A

United States Patent [19]

Solovieff et al.

[11] Patent Number: 5,317,889

[45] Date of Patent: Jun. 7, 1994

[54] FRONT LOADED CYLINDER FOR DOOR LOCKSET

[75] Inventors: Paul G. Solovieff, Tustin; Arnold C. Gater, Anaheim, both of Calif.

[73] Assignee: Emhart Inc., Newark, Del.

[21] Appl. No.: 928,599

[22] Filed: Aug. 13, 1992

[51] Int. Cl.[5] ..... E05B 9/04

[52] U.S. Cl. ..... 70/224; 70/369; 70/371; 70/389

[58] Field of Search ..... 70/367-371, 70/224, 216, 389, 391, DIG. 31, DIG. 39

[56] References Cited

U.S. PATENT DOCUMENTS

| | | | |
|---|---|---|---|
| 378,267 | 2/1888 | Taylor | 70/370 |
| 1,487,307 | 3/1924 | Best . | |
| 1,565,558 | 12/1925 | Fremon | 70/367 X |
| 1,832,108 | 11/1931 | Falk | 70/369 |
| 1,866,342 | 7/1932 | Best | 70/369 |
| 1,914,639 | 6/1933 | Hurd | 70/369 |
| 1,924,069 | 8/1933 | Hurd | 70/369 |
| 1,964,787 | 7/1934 | Voight . | |
| 1,986,676 | 1/1935 | Hurd | 70/369 |
| 1,992,126 | 2/1935 | Hurd . | |
| 2,008,662 | 7/1935 | Bechert | 70/369 |
| 2,012,912 | 8/1935 | Hurd . | |
| 2,023,941 | 12/1935 | Voight | 70/224 |
| 2,061,456 | 11/1936 | Falk . | |
| 2,079,583 | 5/1937 | Brauning | 70/368 |
| 2,199,336 | 4/1940 | Fletcher | 70/371 |
| 2,268,511 | 12/1941 | Ledin | 70/369 |
| 2,620,649 | 12/1952 | Bernardo | 70/358 |
| 3,190,091 | 6/1965 | Russell et al. . | |
| 3,206,958 | 9/1965 | Best . | |
| 3,261,189 | 7/1966 | Best . | |
| 3,324,693 | 6/1967 | Check . | |
| 3,402,582 | 9/1968 | Jacobi | 70/371 |
| 3,422,647 | 1/1969 | Haynes | 70/369 |
| 3,448,599 | 6/1969 | Schreiber | 70/371 |
| 3,492,842 | 2/1970 | Schlage . | |
| 3,527,071 | 9/1970 | Warnod | 70/368 |
| 3,722,243 | 3/1973 | Schiesterl | 70/369 |
| 3,824,817 | 7/1974 | Orr | 70/81 |
| 3,905,213 | 9/1975 | Roberts | 70/368 |
| 4,012,928 | 3/1977 | Dauenbaugh | 70/81 |
| 4,099,397 | 7/1978 | Dauenbaugh | 70/371 |
| 4,143,531 | 3/1979 | Floyd | 70/367 |
| 4,158,952 | 6/1979 | Oliver et al. | 70/52 |
| 4,320,637 | 3/1982 | Wu | 70/224 |
| 4,398,405 | 8/1983 | Patriquin | 70/369 |
| 4,484,462 | 11/1984 | Berkowitz | 70/368 |
| 4,655,059 | 4/1987 | Best et al. | 70/224 |
| 4,672,827 | 6/1987 | Craig | 70/367 |
| 4,672,829 | 6/1987 | Gater et al. | 70/472 |
| 4,712,400 | 12/1987 | Steinbach | 70/369 |
| 4,715,201 | 12/1987 | Craig | 70/369 |
| 4,761,978 | 8/1988 | Walla | 70/367 |
| 4,765,163 | 8/1988 | Trull et al. | 70/224 |
| 4,809,525 | 3/1989 | Cox | 70/100 |
| 4,914,932 | 4/1990 | Walla | 70/367 |
| 4,995,249 | 2/1991 | Preissler et al. | 70/224 |
| 5,186,031 | 2/1993 | Janssen et al. | 70/371 X |

FOREIGN PATENT DOCUMENTS

| | | | |
|---|---|---|---|
| 723037 | 6/1942 | Fed. Rep. of Germany . | |
| 725937 | 10/1933 | France | 70/369 |
| 752937 | 10/1933 | France . | |
| 2164992 | 4/1986 | United Kingdom | 70/369 |

*Primary Examiner*—Lloyd A. Gall
*Attorney, Agent, or Firm*—J. Bruce Hoofnagle

[57] ABSTRACT

A door lockset 20 includes a front loaded cylinder lock 75 which is assembled with an insert 64 within a knob 62. Cylinder lock 75 includes a locking bar 104 which is biased toward a central opening 83 formed through a body 76 of the lock. A plug 80 is located within opening 83 and is rotatable therein. A removal key 108 is formed with a slot 240 which is alignable with a plug slot 109 when the key is inserted into a key slot 113 of the plug. Plug 80 is thereafter rotated within opening 83 to align locking bar 104 with plug slot 109 and key slot 240 whereby the bar moves into the slots under the biasing action of a spring 106. Cylinder lock 75 can then be removed from the front of insert 64 and knob 62. A reverse process is followed to load cylinder lock 75 into opening 238 and to retain the lock with insert 64.

18 Claims, 10 Drawing Sheets

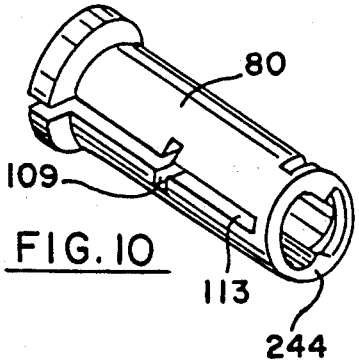
FIG. 10
FIG. 8
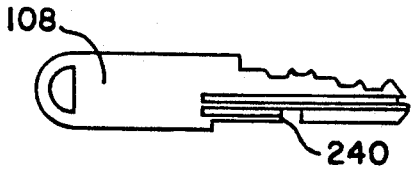
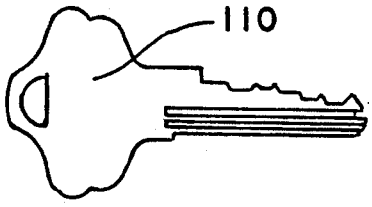
FIG. 9
FIG. 11
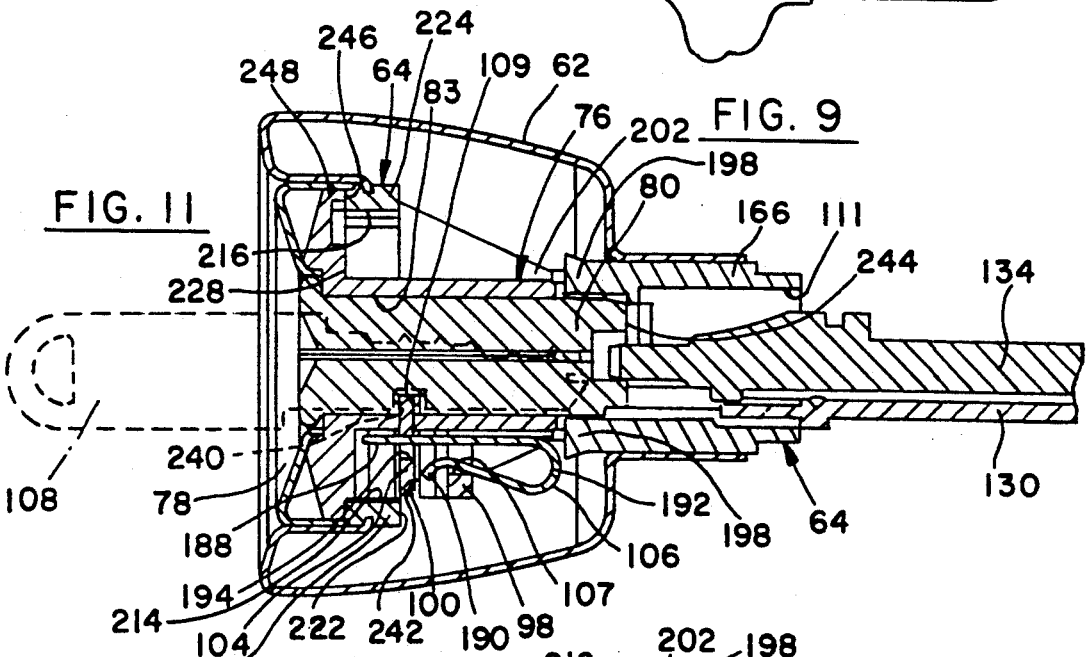
FIG. 12
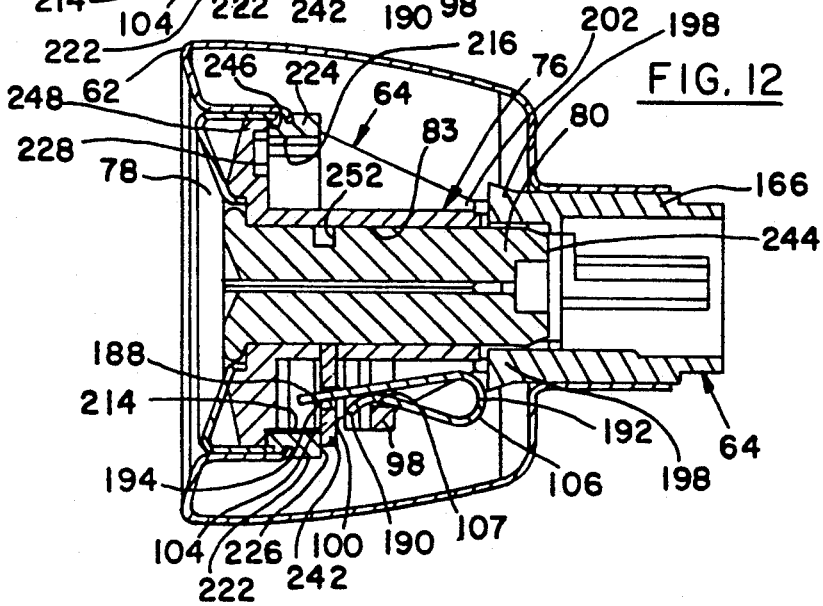

FRONT LOADED CYLINDER FOR DOOR LOCKSET

BACKGROUND OF THE INVENTION

This invention relates to a front loaded cylinder for a door lockset and particularly relates to a door lockset having a cylinder lock which can be removed from or inserted into the front of the lockset without dismantling the lockset from its assembly with a related door.

Some door locksets include a cylinder lock which is typically located in the door operator, such as a knob, or within a guard collar of a deadlock. Such a cylinder lock includes a cylinder body which is formed with a cylindrical opening for receipt of a cylindrically shaped plug for rotation therein. The cylinder body and plug are each formed with a plurality of aligned holes which receive and support sets of spring-biased tumbler pins. Normally, various pins overlap a juncture line between adjacent facing surfaces of the cylinder body and the plug to prevent the plug from rotating relative to the cylinder body. This juncture line is referred to as "the shear line."

The plug is formed with a key slot which communicates with the holes of the plug so that portions of the pins extend into the key slot. When an appropriate key is inserted into the slot, bits on the key adjust the position of the pins so that the shear line is clear and the plug can be rotated within the opening of the cylindrical body.

In some locksets, the cylinder lock is assembled from the rear of the lock set. If a need arises to extract the cylinder lock, the lockset must be dismantled from the door and then disassembled to the extent that the cylinder lock can be removed from the rear of the operator. If it is desired to install a replacement cylinder lock, the same time consuming and tedious process is required.

Other types of locksets use cylinder locks which can be inserted from the front of the operator or deadlock guard collar. Such locksets have alleviated some of the difficulties encountered with the rear loaded cylinder locks. Locksets of this type are useful, for example, where it is necessary or desirable to change the lock combination on a frequent basis. For example, where tenants move and keep the key to the existing lockset, the landlord can simply replace the cylinder lock with one of a different combination by the front loading technique.

While the front-loading technique has simplified the process of replacing a cylinder lock, the available front loaded cylinder locks present complex internal mechanisms, the assembly of which is tedious and time consuming. As a consequence, the cost of such locks is relatively high. Any effort to reduce the cost has been at the expense of the level of security provided by such cylinder lock.

Thus, there is a need for a front loaded cylinder lock which maintains a high level of security for the lockset and which is available at a reasonable cost.

SUMMARY OF THE INVENTION

In light of the need as expressed above, it is an object of this invention to provide a front loaded cylinder lock which is designed for easy removal or insertion relative to a related lockset.

Another object of this invention is to provide a front loaded cylinder lock which is manufactured at a reasonable cost while maintaining a high level of security within its related lockset.

With these and other objects in mind, this invention contemplates a cylinder lock for assembly with a door lock which includes a cylindrical body having a passageway for receipt of a plug. The plug is rotatable within the passageway and is formed with a plurality of spaced holes which are alignable along a shear line with a corresponding plurality of holes formed in the body. The plug is formed with an axial slot which communicates with the holes of the plug. A pair of tumbler pins and a spring are located in each set of aligned holes with the inwardmost pin extending into the axial slot and some of the pins straddling the shear line for precluding movement of the plug relative to the body. A support extends laterally from the body and contains at least partially a locking element which is unattached relative to the support for free movement relative thereto. A biasing element is also contained within the support and is in engagement with the locking element for normally urging the locking element toward the axis of the passageway of the body. A chord-like slot is formed in a peripheral portion of the plug in a plane of the locking element and is positionable for communication with the axial slot of the plug and alignable with the locking element for biasing receipt thereof.

Other objects, features and advantages of the present invention will become more fully apparent from the following detailed description of the preferred embodiment, the appended claims and the accompanying drawings.

BRIEF DESCRIPTION OF THE DRAWINGS

In the drawings:

FIG. 8 is a side view showing the cylinder-lock removal FIG. 3 in accordance with certain principles of the invention;

FIG. 9 is a side view showing the pass key of FIG. 3 for use of the cylinder lock of FIGS. 6 and 7 in a conventional manner;

FIG. 10 is a perspective view of a plug of the cylinder of FIGS. 3, 6 and 7 embodying certain principles of the invention;

FIG. 11 is a sectional view of the cylinder lock of FIGS. 3, 6 and 7 in assembly with a knob and a knob insert and conditioned by the removal key of FIG. 8 for insertion into or removal from the knob and insert;

FIG. 12 is a sectional view of the assembly of FIG. 11 showing the cylinder lock of FIGS. 3, 6 and 7 in secured assembly with the knob and insert in accordance with certain principles of the invention;

DETAILED DESCRIPTION OF THE PREFERRED EMBODIMENT

Figure 1:
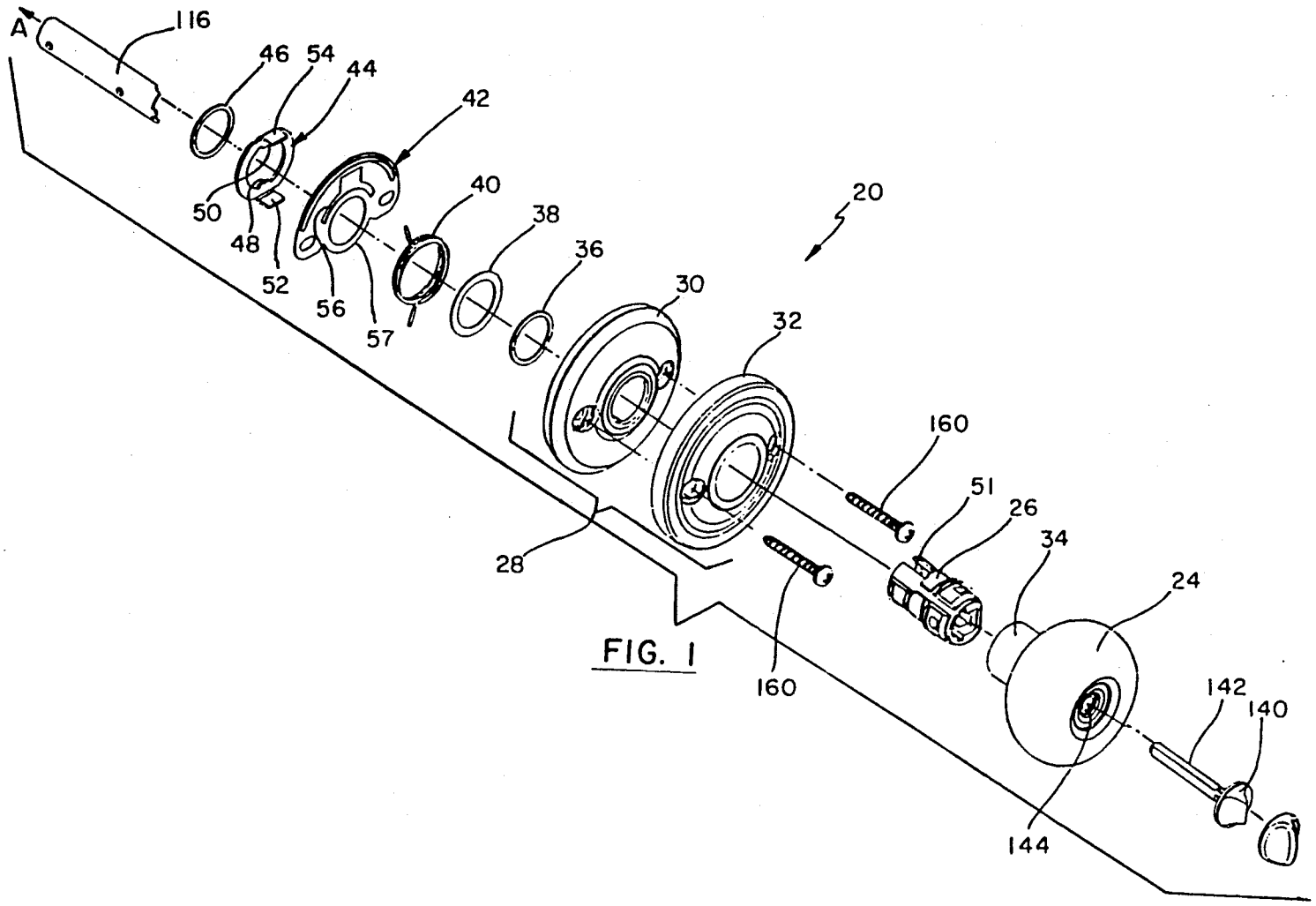
FIGS. 1, 2 and 3 are exploded views which, when combined, illustrate elements of a lockset embodying certain principles of the invention.
Figure 2:
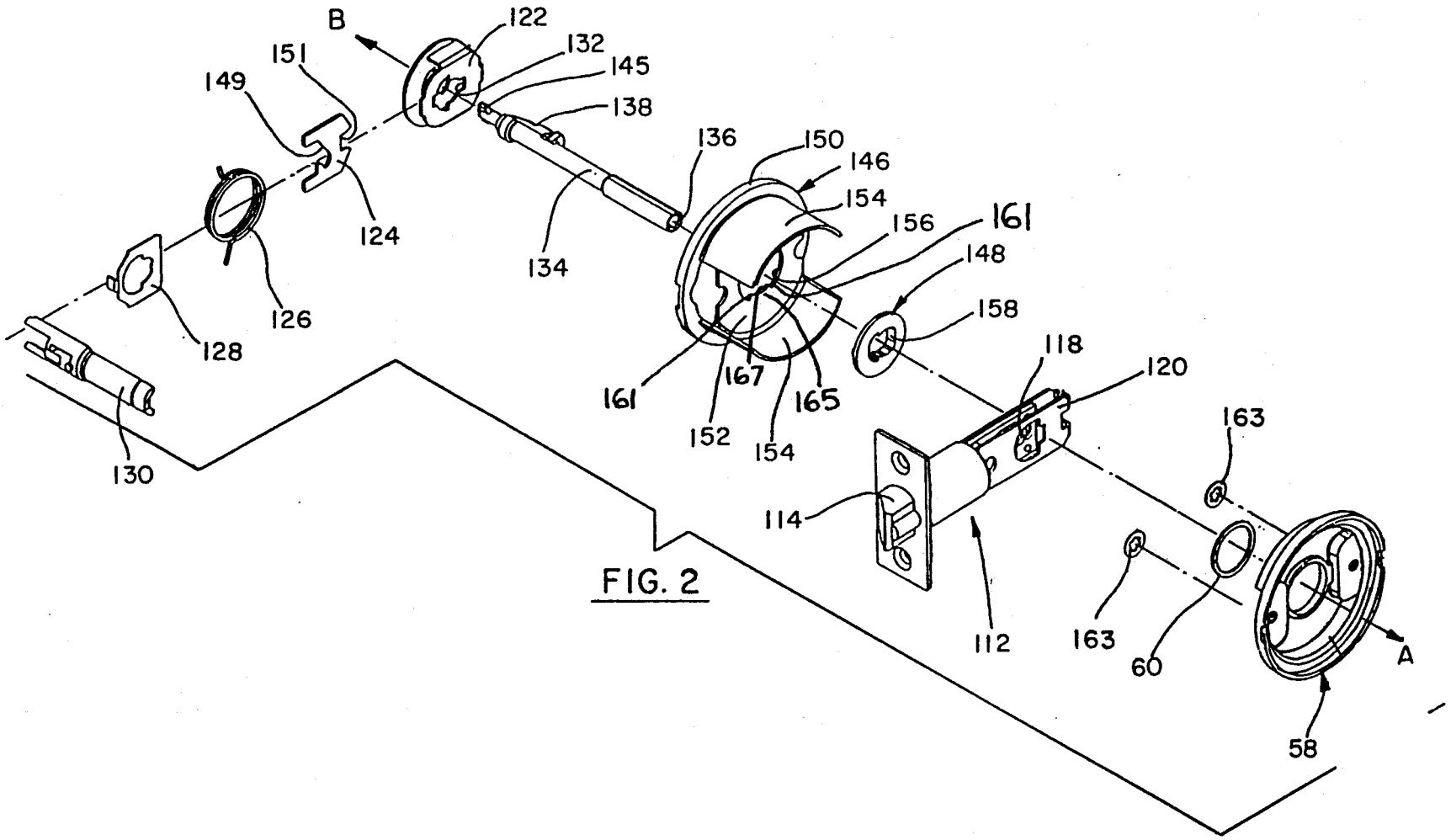
Figures 3, 5:
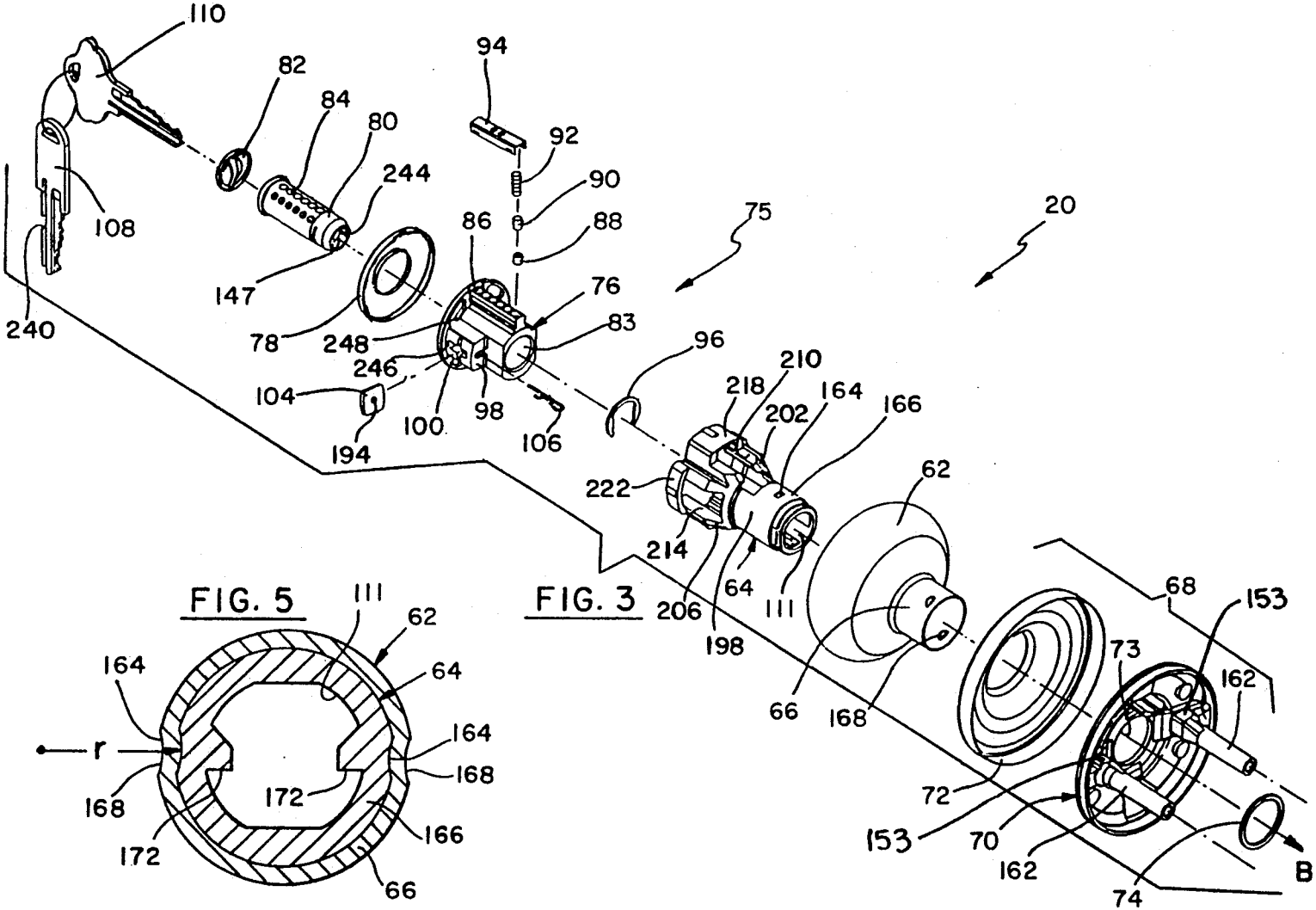
FIG. 5 is a sectional view showing the assembly of a knob sleeve with an insert of the lockset of FIGS. 1, 2 and 3.

FIGS. 1, 2 and 3 illustrate collectively an exploded view of a door lockset 20. To illustrate the complete exploded view of lockset 20, FIGS. 1 and 2 are to be linked at centerline arrowheads "A" and FIGS. 2 and 3 are to be linked at centerline arrowheads "B."

Figure 4:
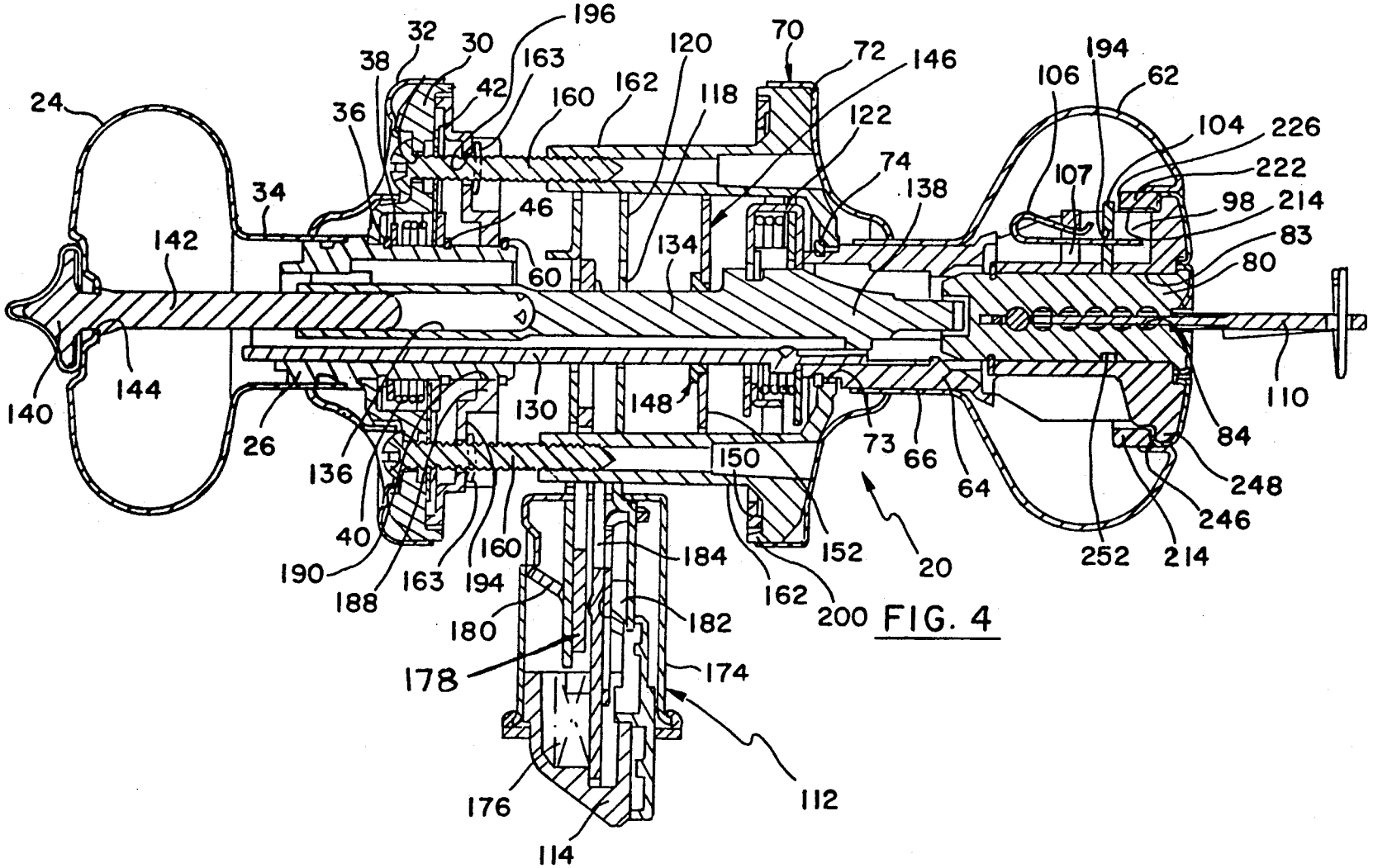
FIG. 4 is an assembly sectional view of the lockset of FIGS. 2 and 3 showing features embodying certain principles of the invention.
Figure 6:
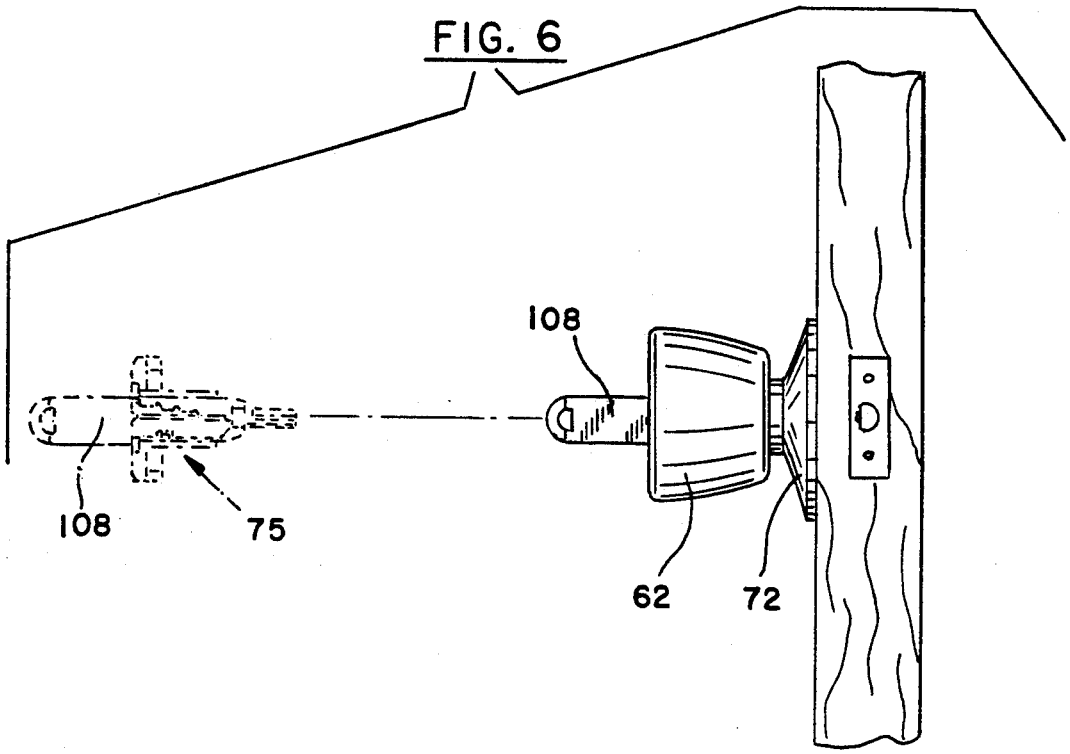
FIG. 6 is a side view showing a door knob in assembly with a and a phantom depiction of the front loaded cylinder lock of FIG. 3 in accordance with certain principles of the invention.

As shown in FIGS. 1 and 4, an interior knob 24 receives a knob insert 26 to facilitate assembly of other elements therewith. A rose assembly 28 consists of a liner 30 and a cover 32. Cover 32 is positioned over insert 26 and a shank 34 of knob 24 while liner 30 is positioned over the insert and is held in position by a retaining ring 36 located on the insert. A spacer washer 38 and a torque spring 40 are positioned on insert 26. A stop plate 42 and a torque spring housing 44 are positioned on insert 26 and held there by a retaining ring 46.

A pair of radially inward tabs 48 and 50 of housing 44 fit into accommodating slots 51 (one shown) of insert 26 so that the housing rotates when knob 24 and the insert are rotated. A pair of tabs 52 and 54 project from a side face of housing 44 and extend respectively through an arcuate slot 56 over an arcuate edge 57 of stop plate 42. A cover 58 (FIG. 2) is then positioned onto insert 26 and is held there by retaining ring 60 (FIG. 2).

As knob 24 is rotated, insert 26 and housing 44 are rotated whereby tabs 52 and 54 increases tension on spring 40. Tabs 52 and 54 also engage the ends of the arcuate slot 56 and edge 57 to limit the rotational travel of knob 24.

As shown in FIG. 3, an exterior knob 62 is designed to receive a knob insert 64 through an opening in the front of the knob and extends partially through an inward end of a shank 66 of the knob. A rose assembly 68, consisting of a liner 70 and a cover 72, is positioned on the inward, extended end of insert 64 so that an opening 73 of the liner is positioned on the insert and the rose assembly is held there by a retaining ring 74.

Also shown in FIG. 3 is a cylinder lock 75 which includes a cylinder body 76, a cylinder cover 78, a plug 80 and a plug cover 82. Plug 80 is inserted into a cylindrical opening 83 of cylinder body 76 so that tumbler pin holes 84 of the plug align with tumbler pin holes 86 of the body. A bottom pin 88, a top pin 90 and a spring 92 are positioned within each of the aligned holes 84 and 86. A cover 94 is positioned over the top of the holes 86 of the body A clip 96 is placed over the inward end of plug 80 to retain the plug with body 76.

Cylinder body 76 is formed with a lateral housing 98 which functions as a support. Housing 98 is formed with a slot 100 which communicates with central opening 83 formed axially through body 76. A locking bar 104 is located within slot 100 and is biased toward opening 83 by a hair-pin spring 106 located in a slot 107. A chord-like slot 109 (FIG. 10) is formed in a portion of the peripheral wall of plug 80 and is positionable with bar 104, and with the use of a slotted removal key 108, to assemble and disassemble cylinder assembly 75 with insert 64 and knob 62. A regular pass key 110 (FIGS. 3 and 9), without a slot in the blade, is used in the conventional manner to turn plug 80 within cylinder body 76. Plug 80 is formed with an axial key slot 113 (FIG. 10) for receipt of keys 108 and 110 and is in communication with slot 107.

Cylinder assembly 75 is assembled within a through opening 238 (FIG. 15) of insert 64 at the outboard end thereof and thereby within the outboard end of knob 62.

As shown in FIG. 2, a door latch assembly 112, including a bolt 114, is positioned to receive a first half-round spindle 116 (FIG. 1) through an opening 118 in a rear frame 120 of the assembly. Spindle 116 is coupled to and driven by knob 24 and the drive elements illustrated in FIG. 1. A lock housing 122 is in axial alignment with the previously described elements of lockset 20 and provides an enclosure for a locking slide 124, a detent spring 126 and a detent slide 128. A second half-round spindle 130 extends through an opening 132 in housing 122 and is coupled to knob 62 for control of rotation of the spindle. Spindle 130 also extends into opening 118 of latch assembly 112.

A round spindle 134 is formed with a square opening 136 at one end thereof and cam ramp 138 near the other end thereof. As viewed in FIG. 1, a turn button 140 has a square shank 142 which is located within an axial opening 144 of knob 24 and into square opening 136 of spindle 134. The opposite end of round spindle 134 is formed with a cross link 145 which is inserted into an axial opening 147 (FIG. 3) in the inboard end of plug 80. Referring to FIGS. 1, 2 and 3, cam ramp 138 is located within opening 132 of housing 122. When turn button 140 is rotated to lock lockset 20 from the interior side of a related door, or plug 80 is rotated to a locked position from the exterior side of the door, cam ramp 138 is positioned to prevent rotation of half-round spindle 130 by an attempt to rotate exterior knob 62. This locking action is accomplished by cam ramp 138 engaging a follower surface 149 of locking slide 124 to move the slide so a notch 151 formed in the slide is positioned about a post extending from the inboard side of liner 70.

It is noted that the ends of spring 126 rest normally against adjacent spaced sides of a pair of spaced lugs 153 (FIG. 3) which extend in an axial direction from the inboard face of liner 70. When knob 62 is operated, one or the other of the ends of spring 126 are moved toward the adjacent-most post 162. If rotation of spindle 130 is not limited otherwise, the ends of spring 126 could engage the adjacent-most post 162 which would serve to limit normal operation of knob 62.

As shown in FIG. 2, a security shield 146 and a bearing 148 are located in axial alignment with other elements. Shield 146 is mounted in a fixed position and is formed with a circular rim 150, a base plate 152, and a pair of arcuate deflectors 154. Base plate 152 is formed with an opening 156 for receipt of a portion bearing 148.

In particular, half round spindle 130 is positioned through an opening 158 of bearing 148 and engages surfaces within the bearing opening to rotate the bearing upon rotation of the spindle. Bearing 148 is formed with lugs (not shown) which engage surfaces 161 (FIG. 2) within opening 156 of base plate 152 to limit the rotary movement of the bearing. This limits the rotary movement of spindle 130 and, thereby, of exterior knob 62. As viewed in FIG. 2, a pair of projections 165 (one shown) having curved surfaces 167 are formed radially inwardly from opposed sides of opening 156 and provide for surfaces 161. Thus, opening 156 has a large diameter portion formed by the vertically spaced walls of the opening as viewed in FIG. 2 and a small diameter portion formed by oppositely spaced inward projections 165.

As shown in FIG. 4, a pair of screws 160 (FIG. 1) are positioned through openings formed in rose cover 32, rose liner 30, stop plate 42, cover 58, shield 146, door latch assembly 112 and into a pair of internally threaded posts 162 which extend from the inner face of rose liner 70.

Referring to FIGS. 3 and 5, a pair of diametrically opposed curved dimples 164 are formed in the outer surface of the periphery of an inward sleeve 166 of insert 64. Also, a pair of diametrically opposed curved projections 168 are formed radially inwardly in shank 66 of knob 62. Upon assembly, the half-round projections 168 of knob 62 are positioned within the half-round dimples 164 of insert 64 to retain the knob with the insert. When a rotary force above a prescribed level is applied to knob 62, projections 168 move out of dimples 164 to allow the knob to slip or rotate independently of insert 64.

The components of lockset 20 can be assembled in two subassemblies at the manufacturing location. For example, a first subassembly includes the interior portion of lockset 20 containing interior knob 24 and the elements of FIG. 1, and also containing cover 58 and retaining ring 60. After assembly of these components, screws 160 are inserted through the aligned openings of the components and project from cover 58 in the manner illustrated in FIG. 4. Thereafter, a pair of washer-like plastic retainers 163 (FIGS. 2 and 4) are placed over the threaded ends of screws 160 and are moved adjacent cover 58 to retain the screws in place. Screws 160 are supported by the holes of liner 30 and cover 58 at spaced locations along the length of the screws so that the screws do not sag and pointed ends thereof are held in place and alignment for ready assembly within threaded posts 162.

A second subassembly includes exterior knob 62, together with the other components of FIG. 3, and further includes lock housing 122, slide 124, spring 126, slide 128, half-round spindle 130, round spindle 134, shield 146 and bearing 148.

In the past, knobs have been assembled with associated inserts by staking the knob sleeve to the insert. When unauthorized entry is attempted by turning the knob beyond its normal operating limit, the area of staked connection would be destroyed and the knob would thereafter slip relative to the insert to preclude unauthorized entry. In this situation, portions of the lockset are destroyed and would have to be replaced. This could involve the ordering of replacement parts with the attendant disassembly and reassembly of the lockset, or the purchase of a new lockset and the attendant removal of the damaged lockset and assembly of the new lockset.

As shown in FIG. 5, the pair of curved dimples 164 formed in sleeve 166 of insert 64 are each formed with a shallow depth with curving ramps which extend with a slight rise from the base of the dimple to the outer periphery of sleeve 166. The curvature is determined by an arc of a circle which has a radius represented by the letter "r." In the preferred embodiment, the radius for the arc which relates to dimples 164 is 0.188 inch. Curved projections 168 which are formed inwardly in shank 66 knob 62 are formed with a curvature complementary to dimples 164 determined by the value of radius "r" minus the thickness of shank 66. In the preferred embodiment the thickness of shank 66 is 0.025 inch.

With the shallow curvature, there is sufficient frictional contact between dimples 164 and projections 168 to retain knob 62 in assembly with insert 64 during instances when the knob is used in normal fashion to retract latch bolt 114. If forcible entry is attempted by twisting knob 62 beyond prescribed limits, projections 168 will be guided out of the shallow dimples 164 and onto the outer periphery of sleeve 166. This action does not destroy dimples 164 or projections 168 but allows knob 62 to rotate separately with respect to insert 64. Eventually, projections 168 could be re-inserted into dimples 164 and knob 62 thereby reassembled with insert 64 for normal use.

Referring further to FIG. 5, a pair of pedestals 172 are formed along opposite wall portions within opening 111 of insert 64. Half-round spindle 130 is positioned within opening 111 of insert 64 with portions of the spindle engaging pedestals 172. Upon rotation of knob 62 in either direction, the pedestals 172 engage and urge spindle 130 to revolve about the axis of lockset 20 whereby bolt 114 is retracted.

Insert 26 is formed with an opening and pedestals in the same manner that insert 64 is formed with opening 111 and pedestals 172. Thus, when knob 24 is rotated, half-round spindle 116 revolves about the axis of lockset 20 also to retract bolt 114.

As shown in FIG. 4, door latch assembly 112 includes bolt 114 mounted in a case 174 and extending from one end thereof. Frame 120 extends from the opposite end of case 174. A spring 176 normally urges bolt 114 outwardly of case 174. When either half-round spindle 116 or half-round spindle 130 are operated, a slide 178 located within frame 120 is moved in a direction away from case 174 and moves a latch cam 180 therewith. Latch cam 180 engages and moves a pair of followers 182 (one shown) to move a bolt extender 184 whereby bolt 114 is retracted into case 174.

Figure 7:
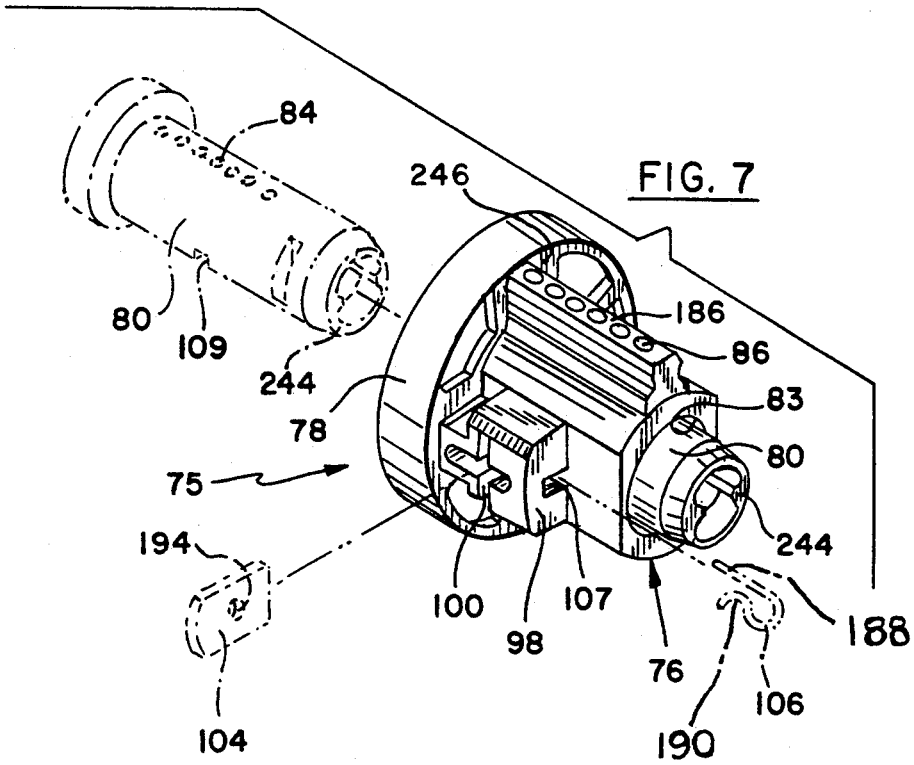
FIG. 7 is a perspective view of the front loaded cylinder FIGS. 3 and 6 in accordance with certain principles of the invention.

Referring to FIG. 7, a chimney 186 extends upwardly from cylindrical body 76 and forms a housing for holes 86 of the body. Further, housing 98 extends laterally from cylindrical body 76 at a position approximately ninety degrees from chimney 186. Spring 106 is formed with a straight leg 188 and a curved leg 190 which are joined integrally by intermediate curved portion 192. Straight leg 188 and curved leg 190 are normally located as illustrated in FIGS. 7 and 11. When straight leg 188 is urged towards curved leg 190, as shown in FIG. 12, spring 106 is biased and the legs tend to move apart as shown in FIG. 7.

Referring to FIG. 12, slot 100 extends through housing 98 and cylindrical body 76 and communicates with cylindrical passageway 83. Locking bar 104 is positioned within slot 100 and is formed with a central opening 194. Spring 106 is positioned within slot 107 of housing 98 so that straight leg 188 is located through central opening 194 to normally urge locking bar 104 toward passageway 83 of cylindrical body 76. However, when plug 80 is located in passageway 83 as illustrated in FIG. 12, locking bar 104 is precluded from moving into the passageway.

Figure 14:
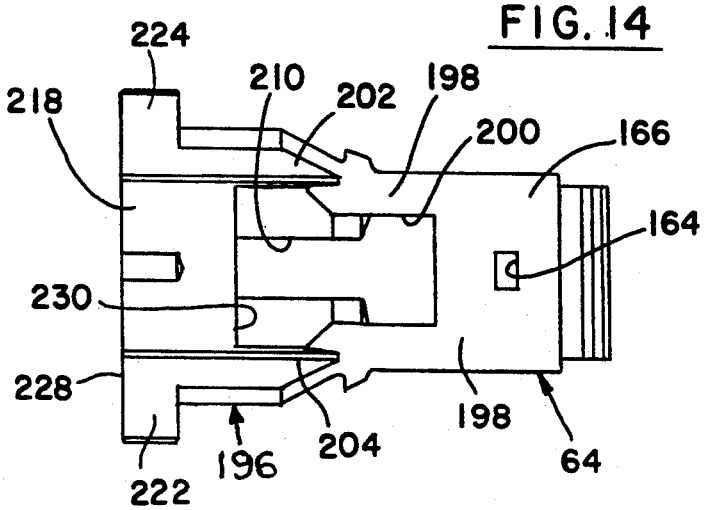
FIG. 14 is a top view of the knob insert of FIGS. 3, 11, 12 and 13 in accordance with certain principles of the invention.
Figure 15:
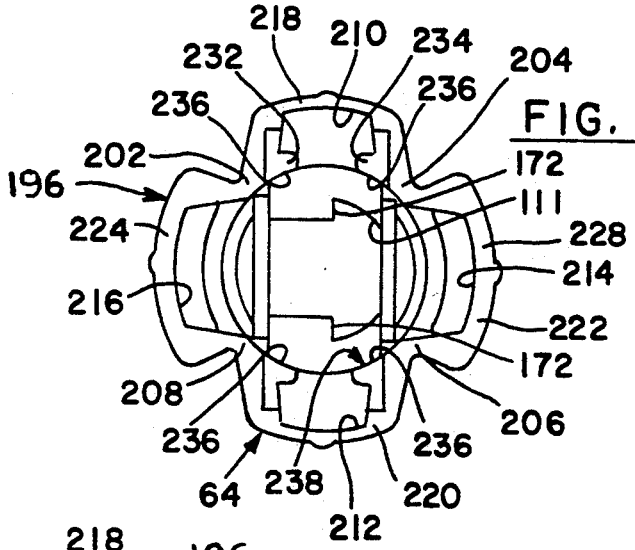
FIG. 15 is a front view of the knob insert of FIGS. 3 and 11 through 14 in accordance with certain principles of the invention.
Figure 13:
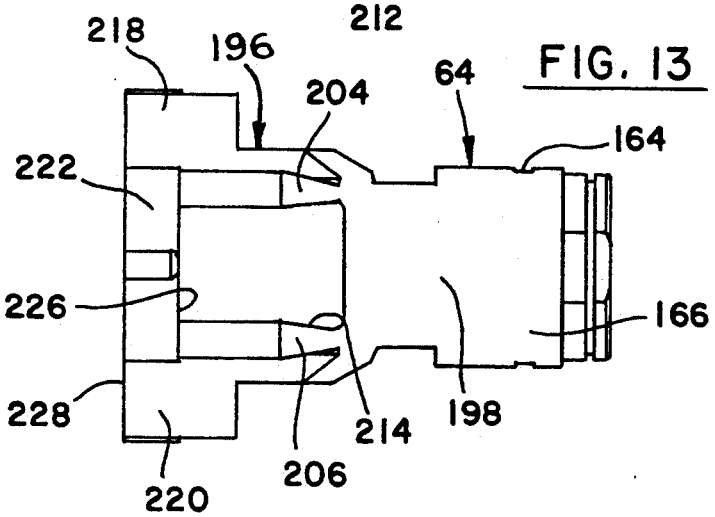
FIG. 13 is a side view showing the knob insert of FIGS. 3, 11 and 12 in accordance with certain principles of the invention.

Referring to FIGS. 13, 14 and 15, insert 64 is composed of a sturdy die cast alloy and includes inward sleeve 166 with opening 111 and pedestals 172 as noted above. An outboard or forward portion 196 is formed in a cage-like configuration for receipt of cylinder lock 75. In particular, forward portion 196 is formed with a pair of side panels 198 which extend forwardly and integrally from sleeve 166 and define an opening 200 therebetween which communicates with opening 111.

Four arms 202, 204, 206 and 208 extend forwardly and integrally from spaced portions of each of the panels 198 to define an upper opening 210, a lower opening 212, a first side opening 214 and a second side opening 216. An upper bridge 218 straddles the forward ends of arms 202 and 204 and provides for a continuation of opening 210 thereunder. In similar fashion, a lower bridge 220 straddles the forward ends of arms 206 and 208. A first side bridge 222 straddles the forward ends of arms 204 and 206 and provides for a continuation of opening 214. In similar fashion, a second side bridge 224 straddles the forward ends of arms 202 and 208. It is noted that bridge 218 and 220 each have a greater front-to-rear dimension than that of bridges 222 and 224. This facilitates the locating of a rear face 226 of bridges 222 and 224 closer to a front face 228 of insert 64 than a rear face 230 of bridges 218 and 220.

As viewed in FIG. 15, a pair of facing projections 232 and 234 extend into opening 210 spacially beneath upper bridge 218 and provide a defined space therebetween. Similar projections extend into opening 212 adjacent lower bridge 220. The inner sidewalls of the portion of opening 214 adjacent first side bridge 222 are tapered while the underside wall of the bridge is arcing. Similar structure appears within the portion of opening 216 adjacent to second side bridge 224. Wall portions 236 extend between openings 210, 212, 214 and 216 and are curved in a circular fashion. Collectively, openings 210, 212, 214 and 216 and wall portions 236 form an opening 238 in the front face 228 of insert 64 which is configured for receipt of cylinder lock 75.

As noted above, insert 64 is preassembled with knob 62. In this manner, front face 228 and opening 238 are exposed at the front opening of knob 62. As shown in FIG. 11, removal key 108 is then inserted into key slot 113 of plug 80 so that a slot 240 of the key is in the plane of locking bar 104 and is aligned with slot 109 of the plug. Key 108 adjusts the sets of tumbler pins 88 and 90 so that the shear line is free of any pin obstructions. Thereafter, key 108 and plug 80 are rotated relative to cylinder body 76 until slot 240 of the key and slot 109 of the plug are aligned with locking bar 104. Since locking bar 104 is being biased inwardly by spring 106, the bar will move into the aligned slots 109 and 240 of plug 80 and key 108, respectively, and come to rest in the base of the slots as shown in FIG. 11. This action moves an outboard end 242 of locking bar 104 to its inward most position whereby the outboard end is now retracted within slot 100 and within housing 98.

Cylinder lock 75 is now positioned for insertion into opening 238 in the front face 228 of insert 64. Initially, chimney 186 is aligned with upper opening 210 of insert 64 and housing 98 is aligned with first side opening 214 while an inboard end 244 (FIG. 7) of plug 80 extends toward front face 228 and opening 238 of the insert. Cylinder lock 75 is then moved so that chimney 186 slides into upper opening 210 and between projections 232 and 234 which define a space therebetween essentially equal to the width of the chimney. Also, housing 98 moves into first side opening 214 which curved portions of cylinder body 76 are guided into opening 238 by curved wall portions 236 of the opening. In this fashion, chimney 186, housing 98 and cylinder body 76 fit, in complementary fashion, into opening 238. Eventually, an inboard face 246 of a front flange 248 of cylinder body 76 engages front face 228 of insert 64 to prevent further inward movement of the cylinder body into opening 238 whereby cylinder lock 75 is fully located within the opening as viewed in FIG. 11. In this position, locking bar 104 has been moved into a plane immediately inboard of rear face 226 of first side bridge 222.

Thereafter, key 108 and plug 80 are rotated to return the key and plug to a position where holes 84 of the plug are aligned with holes 86 of chimney 186 and the key can be extracted. As key 108 and plug 80 are rotated, slots 240 and 109, respectively, are moved away from locking bar 104 whereby the inboard end of the bar engages the peripheral surface of the plug in the plane of slot 109. This action urges locking bar 104 outwardly under the biasing of spring 106 so that outboard end 242 is moved out of slot 100 and into position adjacent to rear face 226 of bridge 222 to thereby lock cylinder lock 75 with insert 64 as shown in FIG. 12. It is noted that, in addition to the sturdy structure of insert 64 and its assembly within lockset 20, the thickness of first side bridge 222 as viewed in FIG. 15 is substantial. This sturdy structure, insert mounting and bridge thickness provide considerable support for cylinder lock 75 within insert 64 and for substantial retention of the cylinder lock within the insert by virtue of locking bar 104 and first side bridge 222.

It is noted that opening 212 and 216, and bridges 220 and 224, respectively, are not used in the above-described arrangement. However, if the hand of the door with which lockset 20 is assembled is changed, these openings and bridges would be used instead of openings 210 and 214 and bridges 218 and 222, respectively. In either mode, the principle of utility is the same as described above due to the symmetrical structure within opening 238.

Regular pass key 110 can now be used to operate cylinder lock 75 in the normal manner. A portion of key 110 will locate in slot 109 of plug 80. When plug 80 and key 110 are rotated, slot 109 eventually aligns with locking bar 104. However, key 110 occupies slot 109 and prevents entry of the inboard end of locking bar 104 into slot 109. Therefore, outboard end 242 of locking bar 104 remains in the position as shown in FIG. 12 adjacent to rear face 226 of bridge 222 to retain cylinder lock 75 with insert 64 and knob 62.

As shown in FIG. 7, slot 109 of plug 80 is located on the opposite side of the periphery of the plug from holes 84. Since housing 98 is located ninety degrees from holes 86 of cylinder body 76, removal key 110 is to be rotated ninety degrees to position slots 109 and 240 in alignment with locking bar 104 to facilitate front loading and unloading of cylinder lock 75. Due to structural travel limitations within lockset 20, plug 80 can only rotate slightly beyond ninety degrees. However, knob 62 and the components assembled therewith to form the exterior subassembly can be removed from assembly with other components of lockset 20 and the door to allow plug 80 to rotate within opening 83 by use of regular pass key 110.

Figure 16:
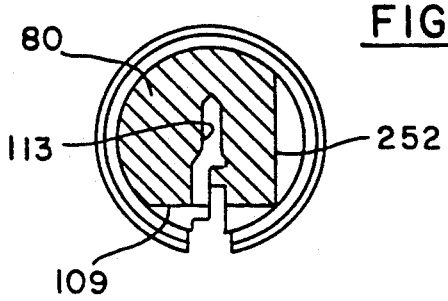
FIG. 16 is a sectional view of the plug of FIGS. 3, 5, 11 and 12 showing the arrangement of chordal-like slots formed in one plane of the plug in accordance with certain principles of the invention.

As additional slot 252 (FIGS. 12 and 16) is formed in the periphery of plug 80 in the plane of slot 109 but spaced beyond the normal travel of the plug during normal use in full assembly of lockset 20. Note that slot 252 is not coincidental with key slot 113 but is merely formed in the periphery of plug 80.

After the exterior subassembly has been removed from full assembly with lockset 20, restrictions on rotation of plug 80 within opening 83 have also been removed. Regular pass key 110 can be inserted into key slot 113 and plug 80 then rotated. If slot 109 is aligned with locking bar 104, key 110 is occupying the slot and prevents movement of the locking bar. However, since rotation restrictions have been removed, plug 80 can continue to be rotated until slot 252 is aligned with locking bar 104 which then moves into the slot to allow front unloading of cylinder lock 75. Front loading of cylinder lock 75 can be accomplished in the reverse manner.

Thus, slot 109 is a primary slot for facilitating front end loading and unloading of cylinder lock 75 and slot 252 is a secondary slot for facilitating front end loading and unloading.

Figure 17:
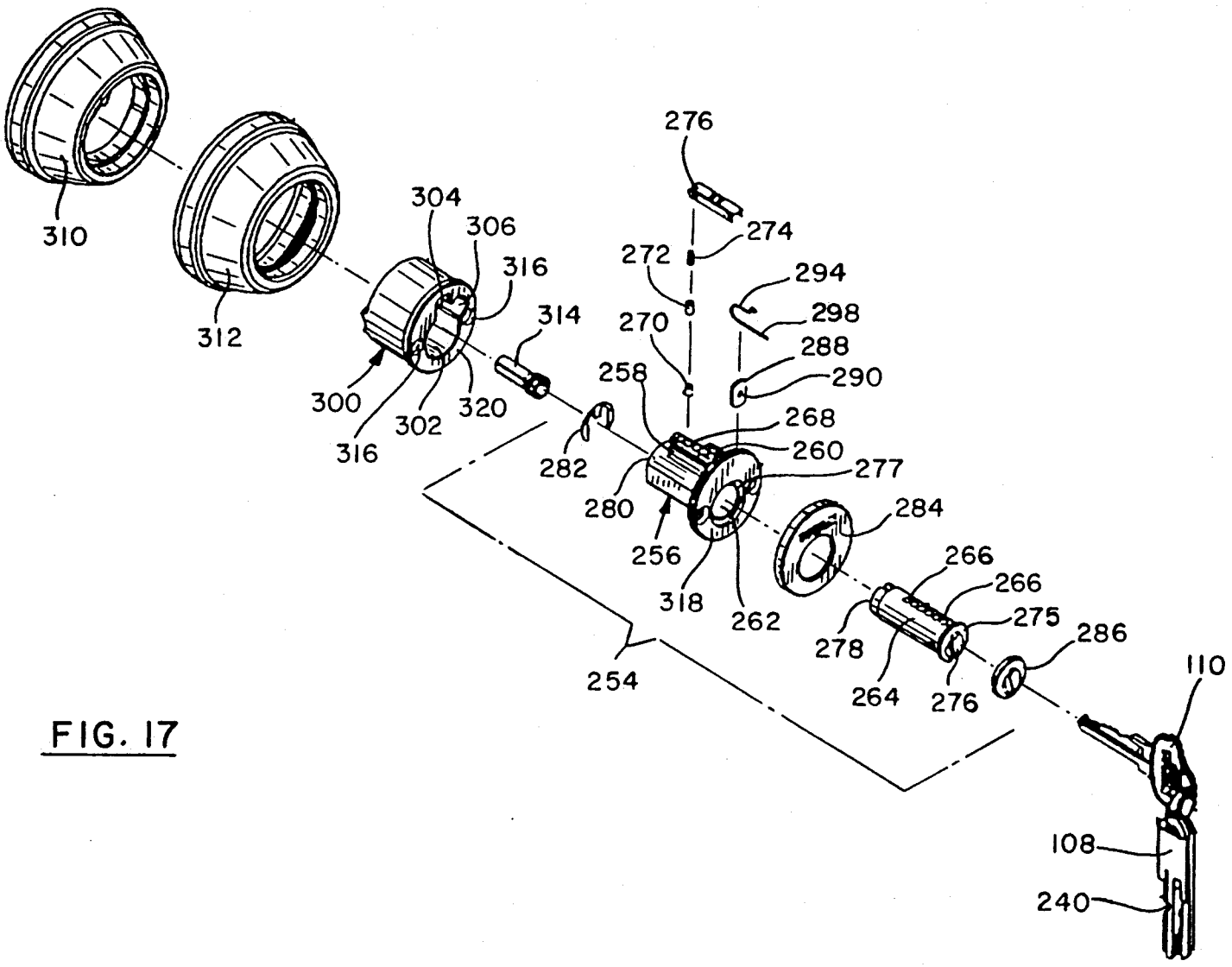
FIG. 17 is an exploded perspective view of a cylinder lock for use with a deadlock in accordance with certain principles of the invention.
Figure 18:
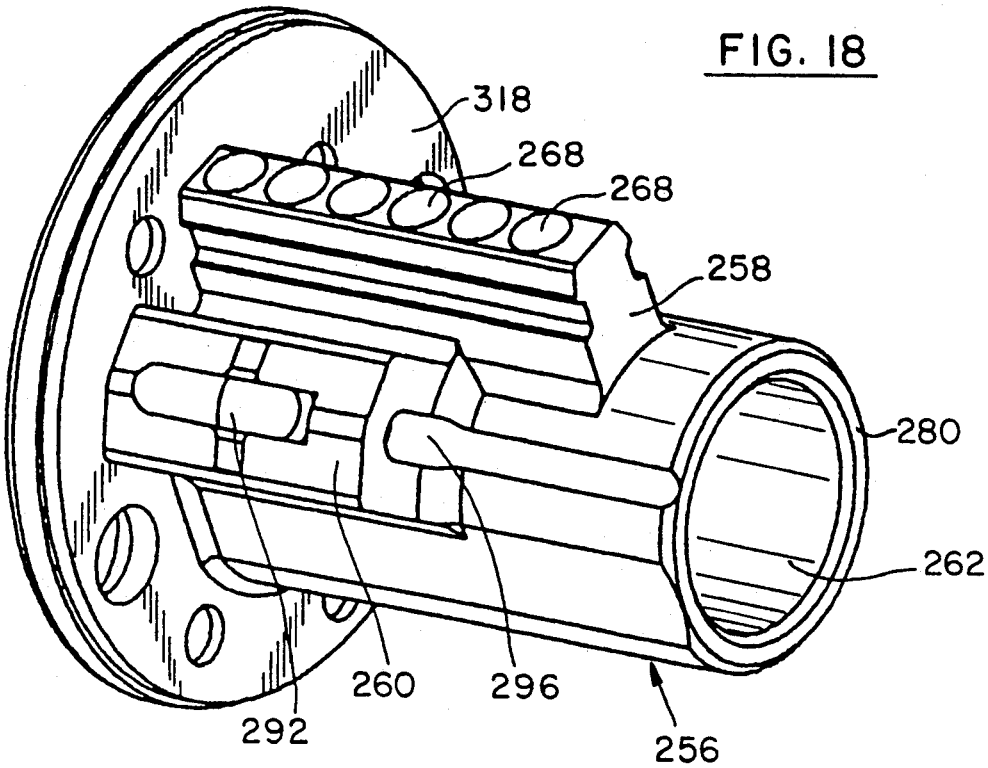
FIG. 18 is a perspective view of a cylinder body of the cylinder lock of FIG. 17 in accordance with certain principles of the invention.

Referring to FIG. 17, a cylindrical lock 254 for a deadlock is shown in exploded view and includes a cylindrical body 256, as further viewed in FIG. 18, with a chimney 258 and a housing 260 each extending radially therefrom. Body 256 is formed with a central opening 262 for receipt of a plug 264 having spaced holes 266 which are alignable with holes 268 formed through chimney 258 and the body. Each of the aligned sets of holes 266 and 268 contain a set of tumbler pins 270 and 272 and a spring 274. A cover 276 is positionable over the outboard ends of holes 268 following assembly of pins 270 and 272 and spring 274 therein.

Plug 264 is formed with a key slot 276 for receipt of regular pass key 110 or removal key 108 which is formed with slot 240. Further, as viewed in FIG. 20, plug 264 is formed with a transverse slot 279 in the periphery thereof and in communication with key slot 276. Slot 279 is identical to slot 109 (FIG. 10) of plug 80. As plug 264 is inserted into opening 262, a flange 275 of the plug seats within a complementary recess 277 of body 256 and an inboard end 278 of the plug protrudes from an inboard end 280 of the body. A clip 282 is placed over the inboard end 278 of plug 264 to retain the plug with body 256.

Decorative covers 284 and 286 are provided for body 256 and plug 264, respectively.

A locking bar 288 is formed with a central opening 290 and is inserted into a slot 292 of (FIG. 18) of housing 260. Slot 292 extends radially inwardly and communicates with opening 262 of body 256. A hair pin spring 294 is inserted into a slot 296 (FIG. 18) formed in housing 260 transversely to slot 292. A straight leg 298 of spring 294 is inserted into opening 290 of bar 288 and normally urges the inboard end of the bar into opening 262.

Figure 20:
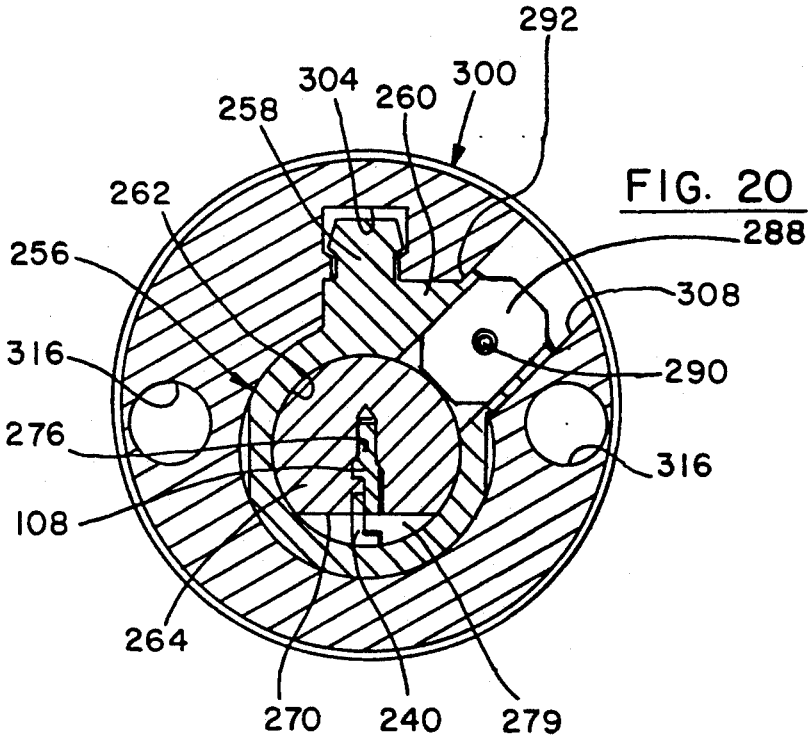
FIG. 20 is a sectional view showing the cylinder lock of FIG. 17 in accordance with certain principles of the invention.
Figure 19:
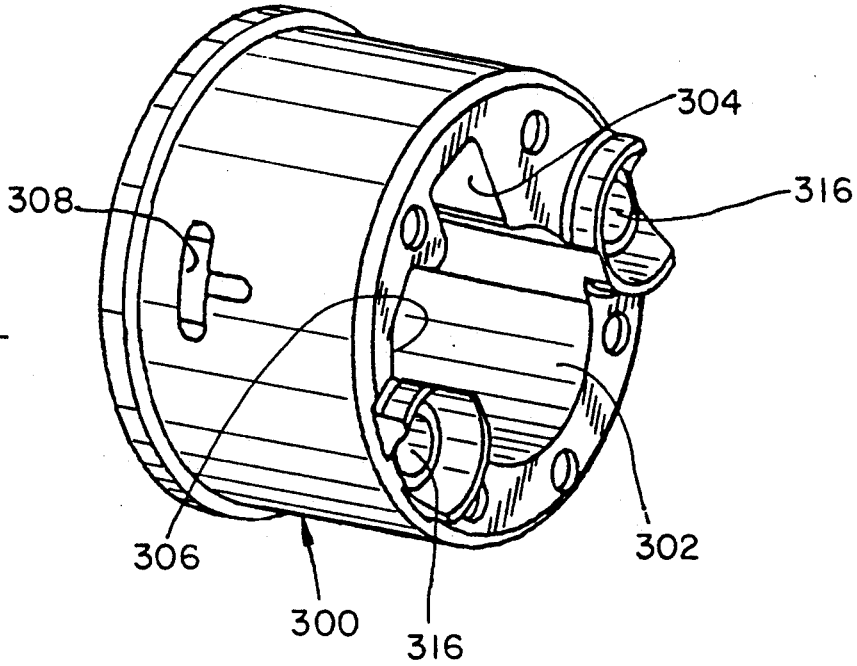
FIG. 19 is a perspective view of an exterior housing of a deadlock in accordance with certain principles of the invention.

As viewed in FIGS. 17, 19 and 20, an exterior housing 300 is formed with a central opening 302 for receipt of cylinder lock 254 and is further formed with channels 304 and 306 which are aligned for complementary receipt of chimney 258 and housing 260, respectively. As shown in FIGS. 19 and 20, a slot 308 is formed in a radial direction in exterior housing 300 and is alignable with slot 292 of body 256 and further with locking bar 288.

Exterior housing 300, with cylinder lock 254 assembled therewith, is assembled with a guard collar 310 and collar cover 312. A torque blade 314 is assembled at one end thereof with inboard end 278 of plug 264 for rotation therewith. The opposite end of blade 314 is assembled with a deadbolt operating mechanism (not shown). Screw holes 316 are formed in housing 300 to facilitate assembly of the housing with other structure of the deadlock and with a door (not shown).

In operation, removal key 108 is inserted into slot 276 of plug 264 whereby slot 240 of the key is coincidental with slot 279 of the plug. Key 108 and plug 264 are rotated to align slots 240 and 279 with locking bar 288 whereby spring 294 urges the inboard end of the bar into slots 240 and 279. Cylinder lock 254 is now inserted into opening 302 of exterior housing 300 until a flange 318 of body 256 engages a front face 320 of the exterior housing. Slot 292 and locking bar 288 are now aligned with slot 308 of exterior housing 300. Key 108 and plug 264 are then rotated to the position shown in FIG. 20 whereby locking bar 288 is urged radially outwardly so that the outboard end of the bar moves into slot 308 of exterior housing 300. The outboard end of locking bar 288 is now confined within slot 308 and precludes axial movement of cylinder lock 254 within opening 302 whereby the lock is secured with exterior housing 300. Cylinder lock 254 can be removed by following a procedure which is the reverse of that just described.

It is noted that housing 260 is located at approximately forty-five degrees from chimney 258 as compared with the ninety degrees location of housing 98 (FIG. 7) with respect to chimney 186. However, the functional aspects of the operation of lockset 20 and the deadlock assembly of cylinder lock 254 and exterior housing 300 are essentially the same.

In general, the above-described embodiments are not to be construed as limiting the breadth of the present invention. Modifications, and other alternative constructions, will be apparent which are within the spirit and scope of the invention as defined in the appended claims.

What is claimed is:

1. A cylinder lock for assembly with a door lock, which comprises:

a cylindrical body having a central passageway formed therethrough along an axis thereof and from a front face to a rear face thereof;

a plurality of spaced parallel transaxis holes formed in the body and in communication with the passageway;

a plug located in the passageway of the body for rotation therein about an axis thereof coincidental with the axis of the body;

a plurality of spaced parallel transaxis holes formed in the plug equal in number to and alignable with the holes of the body;

the interfacing portion between the body and the plug along the region where the holes of the plug are alignable with the holes of the body defining a shear line;

an axial slot formed in the plug in an axial direction in communication with the holes of the plug for receipt of a key;

each of the holes of the body and the plug which are alignable forming a set of holes;

a first tumbler pin, a second tumbler pin and a spring contained within each set of holes with at least one of the pins extending into the slot of the plug and at least the first or second pin normally straddling the shear line to preclude rotation of the plug within the passageway of the body;

a housing which is formed integrally with and extends laterally from the cylindrical body;

a first slot formed in the housing which communicated with the central passageway of the cylindrical body and which extends radially outwardly therefrom;

a locking element located in the first slot of the housing for relative movement therein;

a second slot formed in the housing which communicates with the first slot;

a biasing element located in the second slot in engagement with the locking element for normally urging the locking element relative to the housing toward the axis of the passageway of the body; and a chord-like slot formed in a peripheral portion of the plug in a plane of the locking element which is positionable for communication with the axial slot of the plug and alignable with the locking element for receipt thereof.

2. The cylinder lock as set forth in claim 1 wherein the locking element is formed with an opening and the biasing element is a hair pin spring having a straight leg which is located within the opening of the locking element to normally urge the locking element toward the axis of the passageway of the body.

3. The cylinder lock as set forth in claim 1, wherein the plug is assembled within the central passageway of the cylindrical body; an inboard end of the locking element is in contact with an adjacent portion of a periphery of the plug, and an outboard end of the locking element extends laterally outboard of the housing.

4. The cylinder lock as set forth in claim 3 wherein the chord-like slot of the plug communicates with the axial slot of the plug at a portion of the axial slot contiguous with the peripheral portion of the plug.

5. The cylinder lock as set forth in claim 4 which further comprises a key for insertion into the axial slot, the key being formed with a slot which is alignable with the chord-like slot of the plug so that, upon the locating of the chord-like slot and the key slot adjacent the locking element, the biasing element urges the inboard end of the locking element into the chord-like slot and the key slot and the outboard end of the locking element is located within the housing.

6. The cylinder lock as set forth in claim 1 wherein the chord-like slot is spaced from the axial slot and in a plane which includes the locking element.

7. The cylinder lock as set forth in claim 1 which further comprises a chimney extending radially outwardly from the cylindrical body and which houses extensions of the transaxis holes formed in the body.

8. The cylinder lock as set forth in claim 7 wherein the housing extends radially from the cylindrical body at a location spaced by substantially ninety degrees from the chimney.

9. The cylinder lock as set forth in claim 7 wherein the housing extends radially from the cylindrical body at a location spaced by substantially forty-five degrees from the chimney.

10. The cylinder lock as set forth in claim 1 in assembly with a lockset including a knob, which lockset further comprises:

an insert assembled with the knob;

a receptacle having an entry opening formed by the insert for receipt through the entry opening of the cylinder lock within the insert and the knob;

a lock surface formed on the insert; and the locking element having an outboard end which extends outwardly of the housing and adjacent the lock surface for precluding outward movement of the cylinder lock through the entry opening.

11. The cylinder lock as set forth in claim 10 wherein the receptacle is formed with a cage-like structure which defines the complementary shape of the cylinder lock for receipt thereof.

12. The cylinder lock as set forth in claim 10 wherein the insert is formed with a first portion which is mechanically attached to the knob for movement therewith, and the insert is formed with a second portion which forms the receptacle and which includes spaced arms which extend integrally from the first portion and, by the space between the arms, define portions of the receptacle for receipt of complementary portions of the cylinder lock.

13. The cylinder lock as set forth in claim 12 which further comprises a bridge which straddles at least a pair of the spaced arms and which defines the lock surface.

14. The cylinder lock as set forth in claim 10, wherein a portion of the receptacle is formed with a roof of a prescribed thickness and defines a ceiling of a first compartment for receipt of a portion of the cylinder lock and is formed with a roof of a thickness greater than the prescribed thickness and defines a ceiling of a second compartment for receipt of the housing therein, an inboard edge of the thicker roof of the second compartment forming the lock surface.

15. The cylinder lock as set forth in claim 1 in assembly with elements of a deadlock including an exterior structure having a channel for receipt of the housing.

16. The cylinder lock as set forth in claim 15 wherein the exterior structure is formed with a locking-surface slot which extends from a periphery of the exterior structure inwardly to and in communication with the channel so that the locking element is accessible through the locking-surface slot and inboard portions of the locking-surface slot receive an outboard portion of the locking element when the cylinder lock is secured with the exterior structure.

17. A cylinder lock for assembly with a door lock, which comprises:

a cylindrical body having a central passageway formed therethrough along an axis thereof and from a front face to a rear face thereof;

a plurality of spaced parallel transaxis holes formed in the body and in communication with the passageway;

a plug located in the passageway of the body for rotation therein about an axis thereof coincidental with the axis of the body;

a plurality of spaced parallel transaxis holes formed in the plug equal in number to and alignable with the holes of the body;

the interfacing portion between the body and the plug along the region where the holes of the plug are alignable with the holes of the body defining a shear line;

an axial slot formed in the plug in an axial direction in communication with the holes of the plug for receipt of a key;

each of the holes of the body and the plug which are alignable forming a set of holes;

a first tumbler pin, a second tumbler pin and a spring contained within each set of holes with at least one of the pins extending into the slot of the plug and at least the first or second pin normally straddling the shear line to preclude rotation of the plug within the passageway of the body;

a support extending laterally of the body;

a locking element located adjacent the support and unattached relative to the support for free movement relative thereto;

a biasing element in engagement with the locking element for normally urging the locking element relative to the support toward the axis of the passageway of the body;

a chord-like slot formed in a peripheral portion of the plug in a plane of the locking element which is positionable for communication with the axial slot of the plug and alignable with the locking element for receipt thereof;

the cylinder lock in assembly with a lockset including a knob, which lockset further comprises:

an insert formed with a first portion which is mechanically attached to the knob for movement therewith;

the insert is formed with a second portion which forms a receptacle and which includes spaced arms which extend integrally from the first portion and, by the space between the arms, define portions of the receptacle for receipt of complementary portions of the cylinder lock;

a bridge formed on the insert which straddles at least a pair of the spaced arms and which defines a lock surface; and the locking element having an outboard end which extends outwardly of the support and adjacent the lock surface for precluding outward movement of the cylinder lock from the receptacle.

18. A cylinder lock for assembly with a door lock, which comprises:

a cylindrical body having a central passageway formed therethrough along an axis thereof and from a front face to a rear face thereof;

a plurality of spaced parallel transaxis holes formed in the body and in communication with the passageway;

a plug located in the passageway of the body for rotation therein about an axis thereof coincidental with the axis of the body;

a plurality of spaced parallel transaxis holes formed in the plug equal in number to and alignable with the holes of the body;

the interfacing portion between the body and the plug along the region where the holes of the plug are alignable with the holes of the body defining a shear line;

an axial slot formed in the plug in an axial direction in communication with the holes of the plug for receipt of a key;

each of the holes of the body and the plug which are alignable forming a set of holes;

a first tumbler pin, a second tumbler pin and a spring contained within each set of holes with at least one of the pins extending into the slot of the plug and at least the first or second pin normally straddling the shear line to preclude rotation of the plug within the passageway of the body;

a support extending laterally of the body;

a locking element located adjacent the support and unattached relative to the support for free movement relative thereto;

a biasing element in engagement with the locking element for normally urging the locking element relative to the support toward the axis of the passageway of the body;

a chord-like slot formed in a peripheral portion of the plug in a plane of the locking element which is positionable for communication with the axial slot of the plug and alignable with the locking element for receipt thereof;

the cylinder lock in assembly with a lockset including a knob, which lockset further comprises:

an insert assembled with the knob;

a receptacle having an entry opening formed by the insert for receipt through the entry opening of the cylinder lock within the insert and the knob;

a portion of the receptacle is formed with a roof of a prescribed thickness and defines a ceiling of a first compartment for receipt of a portion of the cylinder lock and is formed with a roof of a thickness greater than the prescribed thickness and defines a ceiling of a second compartment for receipt of the support therein, an inboard edge of the thicker roof of the second compartment forming a lock surface; and the locking element having an outboard end which extends outwardly of the housing and adjacent the lock surface for precluding outward movement of the cylinder lock through the entry opening.

* * * * *